US006805098B2

(12) United States Patent
Koseki et al.

(10) Patent No.: US 6,805,098 B2
(45) Date of Patent: Oct. 19, 2004

(54) APPARATUS AND A METHOD FOR CONTROLLING AN ENGINE

(75) Inventors: Takahisa Koseki, Yokohama (JP); Tetsuya Iwasaki, Tokyo (JP); Takashi Nakazawa, Kawasaki (JP); Masahiko Yuya, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 45 days.

(21) Appl. No.: 10/326,053

(22) Filed: Dec. 23, 2002

(65) Prior Publication Data

US 2003/0116132 A1 Jun. 26, 2003

(30) Foreign Application Priority Data

Dec. 26, 2001 (JP) ..... 2001-394570

(51) Int. Cl.[7] ..... F02D 41/06; F02N 11/08

(52) U.S. Cl. ..... 123/406.54; 123/491; 123/179.18

(58) Field of Search ..... 123/406.54, 406.53, 123/491, 179.18, 179.3, 179.24, 179.28; 701/113

(56) References Cited

U.S. PATENT DOCUMENTS 5,752,488 A * 5/1998 Hattori et al. ..... 123/491
6,647,939 B2 * 11/2003 Manabe et al. ..... 123/179.3
2003/0121487 A1 * 7/2003 Koseki et al. ..... 123/179.3

FOREIGN PATENT DOCUMENTS

EP 1323921 A2 * 7/2003 ..... F02N/11/08
JP 6471 * 1/1999 ..... F01N/11/08
JP 2000-257540 A 9/2000

* cited by examiner

*Primary Examiner*—Hai Huynh
(74) *Attorney, Agent, or Firm*—Foley & Lardner LLP

(57) ABSTRACT

An invention that judges whether an engine is being cranked by a starter based on the conditions that a prior cranking control has ended, the engine rotates at or less than a limit rotation velocity leading to an engine stall, and a battery voltage falls to or below a predetermined value. When such conditions are met, then engine cranking control is started. The engine can be shifted to the cranking control without an input signal from a starter switch and the engine can be promptly cranked.

16 Claims, 7 Drawing Sheets

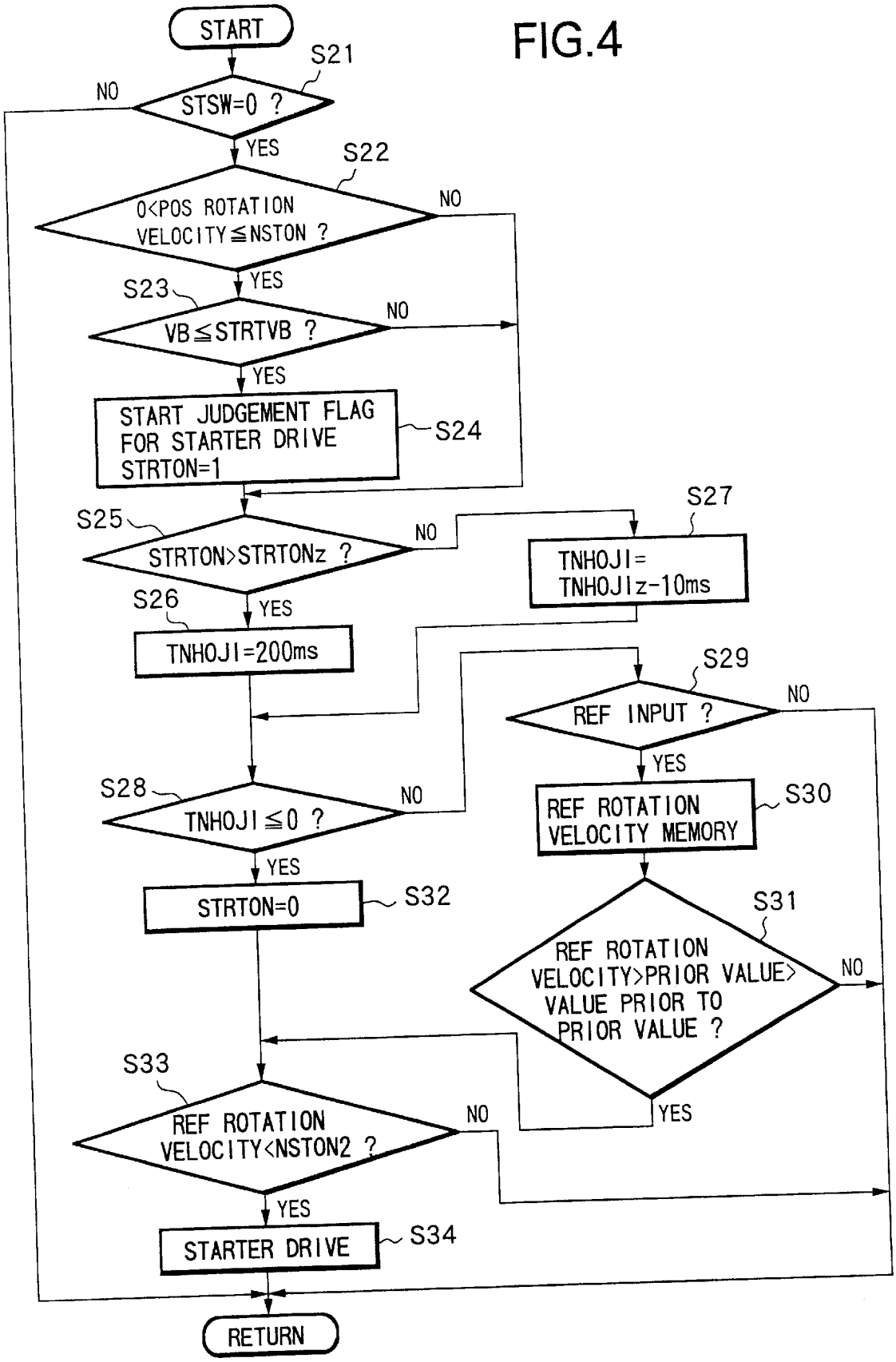
FIG.4
START
S21
STSW=0 ?
NO
YES
S22
0<POS ROTATION VELOCITY≦NSTON ?
NO
YES
S23
VB≦STRTVB ?
NO
YES
START JUDGEMENT FLAG FOR STARTER DRIVE STRTON=1
S24
S25
STRTON>STRTONz ?
NO
YES
S26
TNHOJI=200ms
S27
TNHOJI= TNHOJIz-10ms
S28
TNHOJI≦0 ?
NO
YES
STRTON=0
S32
S29
REF INPUT ?
NO
YES
REF ROTATION VELOCITY MEMORY
S30
S31
REF ROTATION VELOCITY>PRIOR VALUE> VALUE PRIOR TO PRIOR VALUE ?
NO
YES
S33
REF ROTATION VELOCITY<NSTON2 ?
NO
YES
STARTER DRIVE
S34
RETURN

APPARATUS AND A METHOD FOR CONTROLLING AN ENGINE

FIELD OF THE INVENTION

The present invention relates to engine control; more specifically, to starting engine cranking control by simply detecting an engine cranking that is caused by an engine starter.

RELATED ART OF THE INVENTION

In an earlier vehicle engine, in order to ensure engine start performance by shortening an engine cranking period, fuel injection control, an ignition timing control and an air quantity control inherent for an engine cranking are performed during a cranking period based upon detection of cranking.

The start of the cranking period is detected by inputting a starter switch signal attached to an ignition key cylinder to an engine control unit (ECU). For this detection, a harness from a starter switch to an input terminal of ECU has been used, which increases costs. Therefore, in another earlier technology, the start of engine rotation is judged as when an engine rotation signal is input from a crank angle sensor and then, the engine cranking control is started (Japanese Unexamined Patent Publication No. 2000-257540).

SUMMARY OF THE INVENTION

In the above earlier technology, when the engine rotation starts from a condition of no engine rotation, the engine rotation start is detected accurately.

However, when a starter is driven immediately before the engine stops (such as near or at engine stall), because no shift to the engine cranking control is made, the engine is not promptly cranked. Rather, the engine speed must first reach zero, which can be time-consuming.

Further, because the engine will receive an opposite direction force immediately after the engine stops, an engine rotation velocity may be recognized erroneously. On this occasion, the engine is not promptly cranked.

One aspect of the present invention, in view of the foregoing problem, performs a prompt shift to an engine cranking control by accurately detecting a cranking period based upon an engine condition separate from a starter drive signal.

The present invention, in order to achieve the above aspect, involves detecting start of an engine cranking control by estimating that an engine is cranked by a starter on condition that a prior engine cranking control ends, an engine rotation velocity is equal to or less than a limit velocity leading to an engine stall, and a voltage of a starter driving power falls to or below a predetermined low value.

This and other aspects and features of this invention will be understood from the following description with accompanying drawings.

BRIEF EXPLANATION OF THE DRAWINGS

FIG. 4 is a flowchart showing a routine judging a starter drive during an engine rotation.

DETAILED DESCRIPTION OF THE PREFERRED EMBODIMENTS OF THE INVENTION

Selected embodiments of the present invention will be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
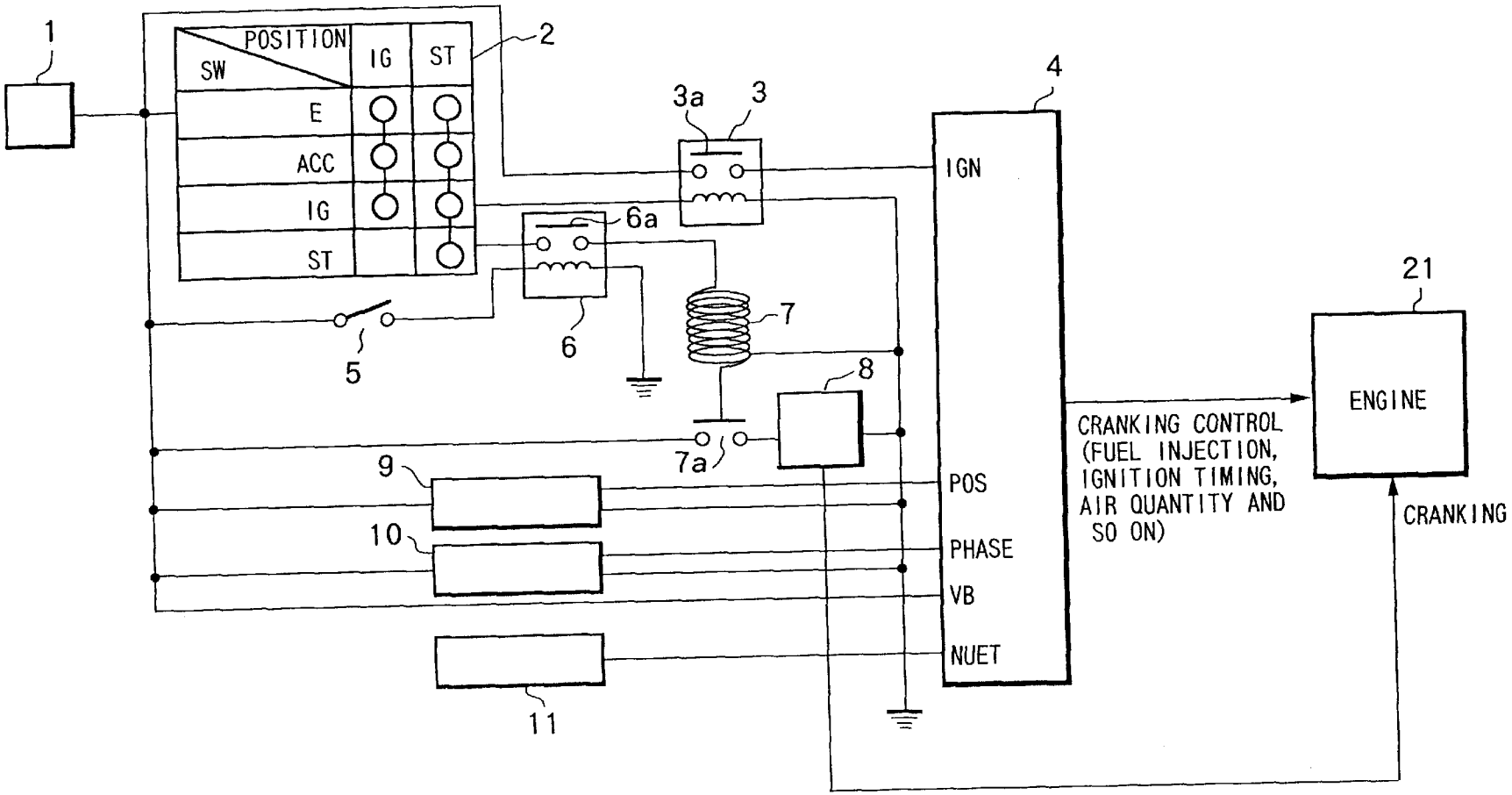
FIG. 1 is a block circuit view of an engine cranking control apparatus according to the invention.

FIG. 1 shows a block circuit structure of an engine cranking control apparatus for an engine according to the invention. A key switch 2 of an engine 21 is connected to a battery 1. When key switch 2 is placed at an ignition position IG or a start position ST, power is supplied to an ignition relay 3 and a contact point 3*a* switches on.

As a result, an ignition signal is input to an ignition terminal IGN to an engine control unit (ECU) 4 to drive an ignition circuit.

An inhibitor switch 5, which switches on at a neutral position of an automatic transmission (or a clutch interlock switch which switches on at a clutch release state of a manual transmission), is connected to battery 1.

When inhibitor switch 5 switches on, namely, at a neutral position, power is supplied to starter relay 6 connected to inhibitor switch 5 and a contact point 6*a* switches on. In this state, if key switch 2 is set at the start position, the power is supplied to a second relay switch 7 through contact point 6*a* and a contact point 7*a* thereof switches on to drive a starter 8. As a result, engine 21 is cranked.

Further, a crank angle sensor 9 and a cam sensor 10 are connected to battery 1. Crank angle sensor 9 outputs a position (POS) signal for each unit crank angle (for example, 10 degrees) during rotation of engine 21. Cam sensor 10 outputs a PHASE signal for cylinder identification in synchronization with rotation of a cam shaft which drives an intake valve and an exhaust valve of engine 21.

These signals are input to the POS terminal and the PHASE terminal of ECU 4, respectively. ECU 4 detects an engine rotation velocity Ne and a crank angle position based upon the POS signal and the PHASE signal to identify a cylinder, as well as to judge the cranking period.

The ECU 4, based on the cranking period judgement, performs engine cranking control actions such as fuel injection, ignition timing, and an air quantity to engine 21 during the cranking period. Further, a voltage VB signal from battery 1 is input to a VB terminal in ECU 4 where a battery voltage detection unit (not shown) detects a voltage value. In addition, a neutral signal from a neutral switch 11 is input to a NUET terminal of the ECU 4.

The engine cranking control based upon the cranking period judgement will be explained according to flowcharts in FIG. 2–FIG. 4 with reference to time charts in FIG. 5 and FIG. 6.

Figure 2:
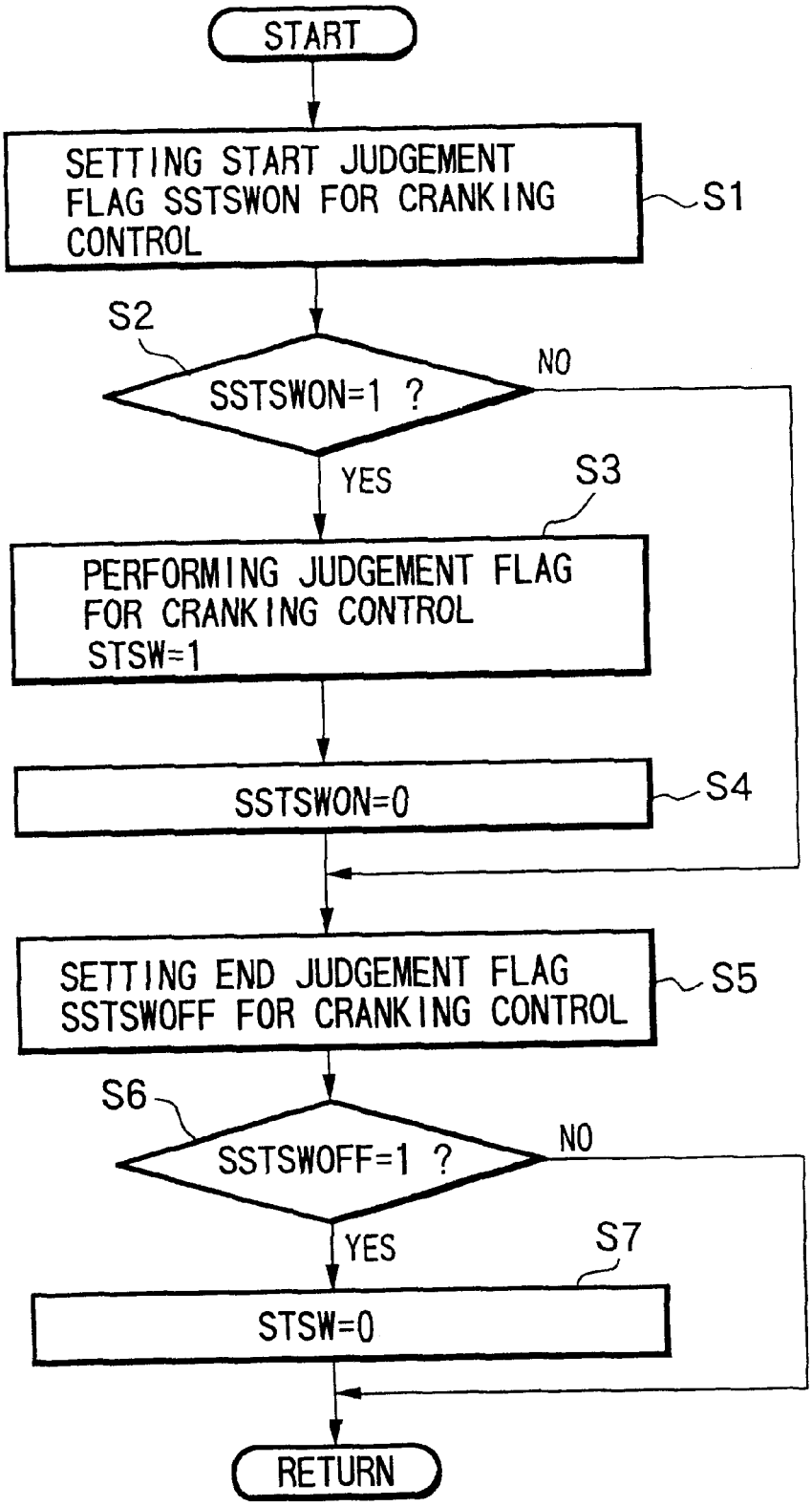
FIG. 2 is a flowchart showing a main routine in a cranking control of the engine cranking control apparatus.

FIG. 2 shows a main routine for the engine cranking control. This flow is executed at a periodic, predetermined cycle (for example, every 10 ms).

At step S 1, a value of a start judgement flag SSTSWON for the engine cranking control is set. This setting is explained in more detail below.

At step S 2, it is judged whether or not the value of the flag SSTSWON is set as 1. If the value of the flag SSTSWON is 1, the process goes to step S 3, wherein an execution judgement flag STSW for the engine cranking control is set as 1, and at step S 4, the value of the flag SSTSWON is reset as 0. Thereafter, at step S 5, the value of an end judgement flag SSTSWOFF for the engine cranking control is set.

Also, at step S 2, if the value of the flag SSTSWON is 0, the process goes directly to step S 5, where the value of the end judgement flag SSTSWOFF for the engine cranking control is set. A setting method for the value of the flag SSTSWOFF is explained below. At step S 6, it is judged whether or not the value of the end judgement flag SSTSWOFF for the engine cranking control is 1. When the value is 1, the process goes to step S 7, where, after the value STSW is reset as 0, the routine ends.

Next, a routine for setting the value of the start judgement flag SSTSWON for the engine cranking control will be explained in reference to FIG. 3.

At step S 11, it is judged whether or not an ignition switch is on, and at step S 12, it is judged whether or not neutral switch 11 is on. When both switches are on, the process goes to step S 13, wherein the routine determines whether or not engine rotation velocity Ne, calculated based upon the POS signal, is 0.

If the engine rotation velocity Ne is judged to be 0, it is judged whether or not the POS signal or the PHASE signal is input at step S 14. When an input exists, the process goes to step S 15, wherein the value of the start judgement flag SSTSWON for the engine cranking control is set as 1.

To this point, the steps are essentially the same as Japanese Unexamined Patent Publication No. 2000-257540, where, by detecting that the engine starts to rotate from an engine stopped condition, the engine cranking control can be started.

When it is judged that engine rotation velocity Ne is not 0 at step S 13, that is, when the engine is rotating, the process goes to step S 16, where it is judged that a starter has been cranked during engine rotation. The judgement will be explained in detail below.

At step S 17, it is judged whether or not, based upon the result from step S 16, the engine is cranking due to the starter drive. When it is judged that the engine is cranking, the process goes to step S 15, wherein the value of the start judgement flag SSTSWON for the cranking control is set as 1.

Details of judging the starter cranking judgement during engine rotation (step S 16) will be explained with reference to FIG. 4.

At step S 21, it is judged whether or not the value of the flag STSW becomes 0. When the value of the flag is judged to be 0, namely, the prior cranking control ends, the process goes to step S 22. At step S 22, it is judged whether or not the engine rotation velocity (POS rotation velocity) detected based upon the POS signal is more than 0, but equal to or less than a limit rotation velocity NSTON leading to an engine stall.

When the above condition is judged to be met, the process goes to step S 23, which judges whether or not a battery voltage is equal to or less than a predetermined value STRTVB. The predetermined value STRTVB is set taking into account the battery voltage as lowered by driving the starter.

When it is detected that the battery voltage VB is equal to or less than a predetermined value STRTVB, it is basically judged that the engine is during the cranking caused by the starter drive. Then, the process goes to step S 24, wherein a start judgement flag STRTON for the starter drive is set as 1. In a simple control, the cranking control may be started by this judgement.

At step S 25, the routine judges whether the engine is in a state immediately after the flag STRTON has switched from 0 to 1. When the engine is in a state immediate after this switching, the process goes to step S 26, where an initial value (for example, 200 ms) is set to a timer TNHOJI which counts an elapse time after the switching.

If the engine is not in the state immediate after the switching (including the second time after the switching), the process goes to step S 27, wherein the value of the timer TNHOJI is repeatedly subtracted by a predetermined value (for example, 10 ms).

At step S 28, it is judged whether or not the value of the timer TNHOJ I is equal to or less than 0. When it is more than 0, that is, the elapse time after the flag STRTON switches from 0 to 1 is within a predetermined time (for example, 200 ms), the process goes to step S 29, where it is judged whether or not a REF signal is input. The REF signal, as shown in FIG. 5 and FIG. 6, detects a non-tooth portion showing non-POS signal output for each crank angle (360 degrees×2/cylinder number in a case of a four stroke engine) corresponding to a phase difference between cylinders by a ratio of a prior value of a POS signal cycle and a current value thereof and is outputted at its detection.

Accordingly, a REF signal output cycle is sufficiently large compared with the POS signal output cycle.

When it is judged that the REF signal is input, the process goes to step S 30, wherein the engine rotation velocity (REF rotation velocity) as a value proportional to a reverse number of REF signal output cycle is detected and is stored in memory.

At step S 31, it is judged whether or not the REF rotation velocity increases at least twice successively. If it does increase at least twice successively row, the process goes to step S 33, where it is judged whether or not the latest REF rotation velocity is less than a lower limit rotation velocity NSTON 2 at an engine combustion completion (where the engine can rotate only by an engine combustion force).

When it is judged that it is less than the lower limit rotation velocity NSTON 2, it is judged that the engine is cranking by the starter drive and it does not reach the engine combustion completion (self-rotation).

Figure 3:
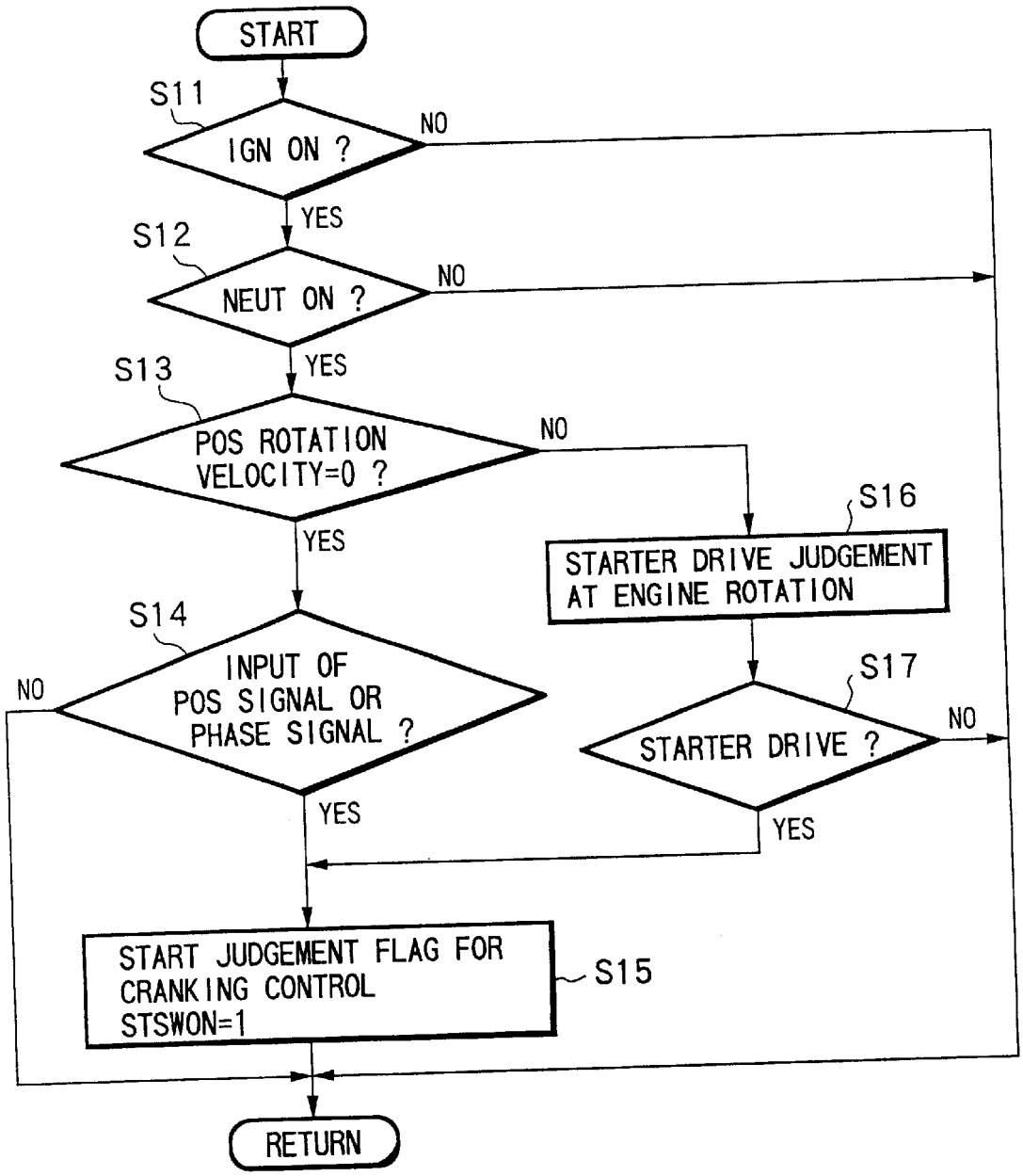
FIG. 3 is a flowchart showing a routine setting a start judgement flag for the cranking control.

As a result, it is judged that the engine is cranking and the cranking is done by the starter during engine rotation, which results in a judgement of "yes" at step S 17 in FIG. 3.

Figure 5:
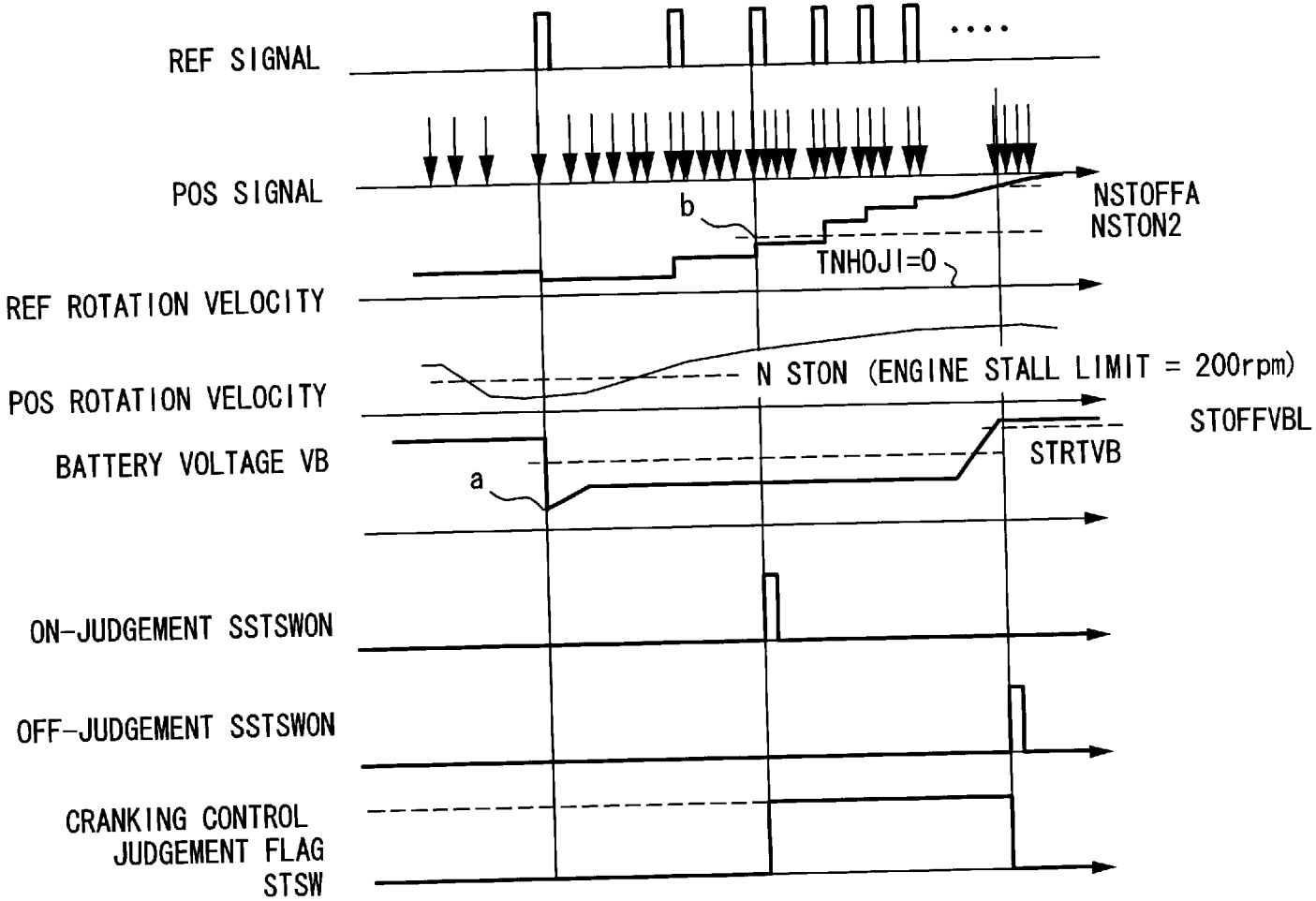
FIG. 5 is a time chart showing one embodiment for judging the starter drive during the engine rotation.

FIG. 5 shows a time chart for judging that the engine is cranking by the starter using the above routine. As the starter starts to be driven during engine rotation (POS signal is input and POS rotation velocity is not 0), the battery voltage VB is lowered by a large margin to be under STRTVB (point "a" in FIG. 5).

Afterwards, at point "b" in FIG. 5, the REF rotation velocity increases twice in a row before a predetermined time elapses (where the value of the timer TNHOJI reaches 0), and the REF rotation velocity is also less than the lower limit rotation velocity NSTON 2. Therefore, it is judged that the engine is cranked caused by the starter drive and the flag SSTSWON is set temporarily, as well as the judgement flag STSW for the cranking control is set.

Returning to FIG. 4, at step S 28, if the value of the timer TNHOJI is equal to or less than 0, namely, it is judged that an elapse time after the flag STRTON switches from 0 to 1 has reached a predetermined time (for example, 200 ms), the process goes to step S 32, wherein the flag STRTON is reset as 0.

Then, the process goes to step S 33, wherein when it is judged that the REF rotation velocity is less than the lower limit rotation velocity NSTON 2 by comparing the REF rotation velocity with the NSTON 2, it is judged that the engine is cranking caused by the starter drive during engine rotation.

Figure 6:
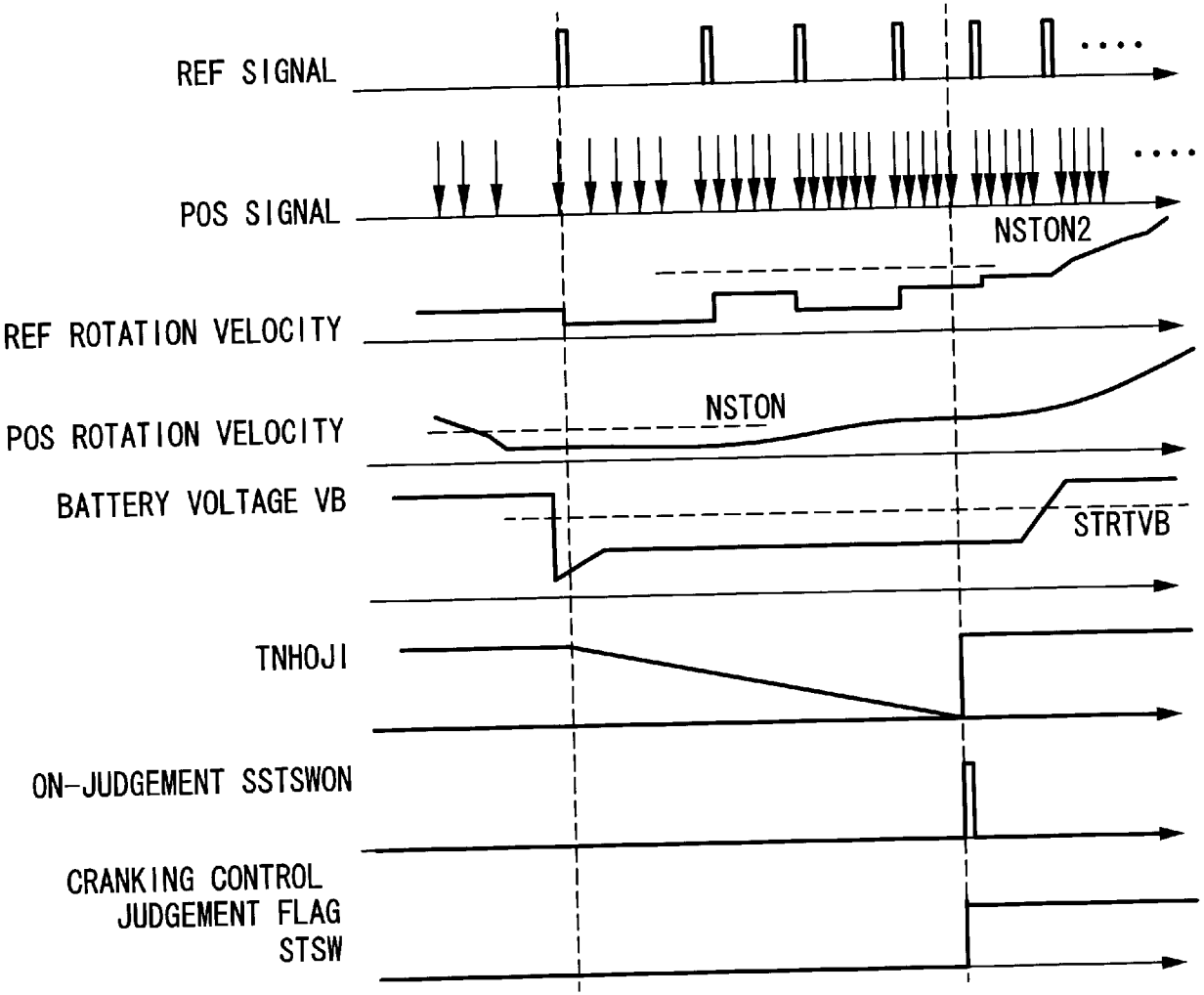
FIG. 6 is a time chart showing another embodiment for judging the starter drive during the engine rotation.

Namely, as shown in FIG. 6, in a case the REF rotation does not increase at least twice before a predetermined time elapses after the flag STRTON switches from 0 to 1 and the REF rotation velocity is maintained less than the lower limit rotation velocity NSTON 2 at a predetermined time elapse point, it is judged that the engine is cranking caused by the starter drive during the engine rotation.

Thus, as described above, even when a driver starts a cranking operation for driving the starter in a condition where engine 21 rotates too slowly for self-rotation, the starter cranking can be estimated based upon a battery voltage decrease and later movement of the engine rotation velocity.

Therefore, without relying on the starter switch signal, the engine is shifted to cranking control and begins cranking promptly.

After decrease of the battery voltage is detected during the engine rotation, further when it is detected that the engine rotation velocity is less than the lower limit rotation velocity NSTON 2 and increases a plurality of times in a row or it is detected that the engine rotation velocity after the predetermined time elapse is less than the lower limit rotation velocity NSTON 2, it is judged that the engine is cranking caused by the starter drive.

Accordingly, an error judgement caused by a battery voltage decrease by a noise of the battery voltage and by a power supply to electrical devices or an engine rotation fluctuation by swinging back and forth is prevented. Thus, cranking control is performed only when it is in fact required.

On the other hand, in a case after the above increase or after a predetermined time elapse after the noted condition is met, the engine rotation velocity increases up to more than a rotation velocity at an engine combustion completion, the cranking control is not required due to self-rotation of the engine.

If the cranking control is performed on this occasion, an engine idling occurs, reducing fuel economy. With the present embodiments of the invention, it is determined that engine cranking is not caused by the starter drive, and the shift to the cranking control can be prevented.

In addition, at an extremely low rotation like almost an engine stall, the fluctuation of the engine rotation velocity is strong, if an engine rotation velocity increase is detected by a signal with a short output cycle, it may be judged by mistake that the engine cranking is done by the starter drive.

Therefore, it is judged whether or not the engine rotation velocity increases using an engine rotation detection signal (REF signal) with a cycle longer than a cycle of an engine rotation signal (POS signal) used when it is judged whether or not the engine is less than the lower limit rotation velocity NSTON 2. As a result, an error judgement caused by the rotation velocity fluctuation is prevented.

Since the starter drive during the engine rotation is accurately detected as explained above, the harness for the signal input is not necessary without input of the signal from the starter switch, reducing overall system cost.

Figure 7:
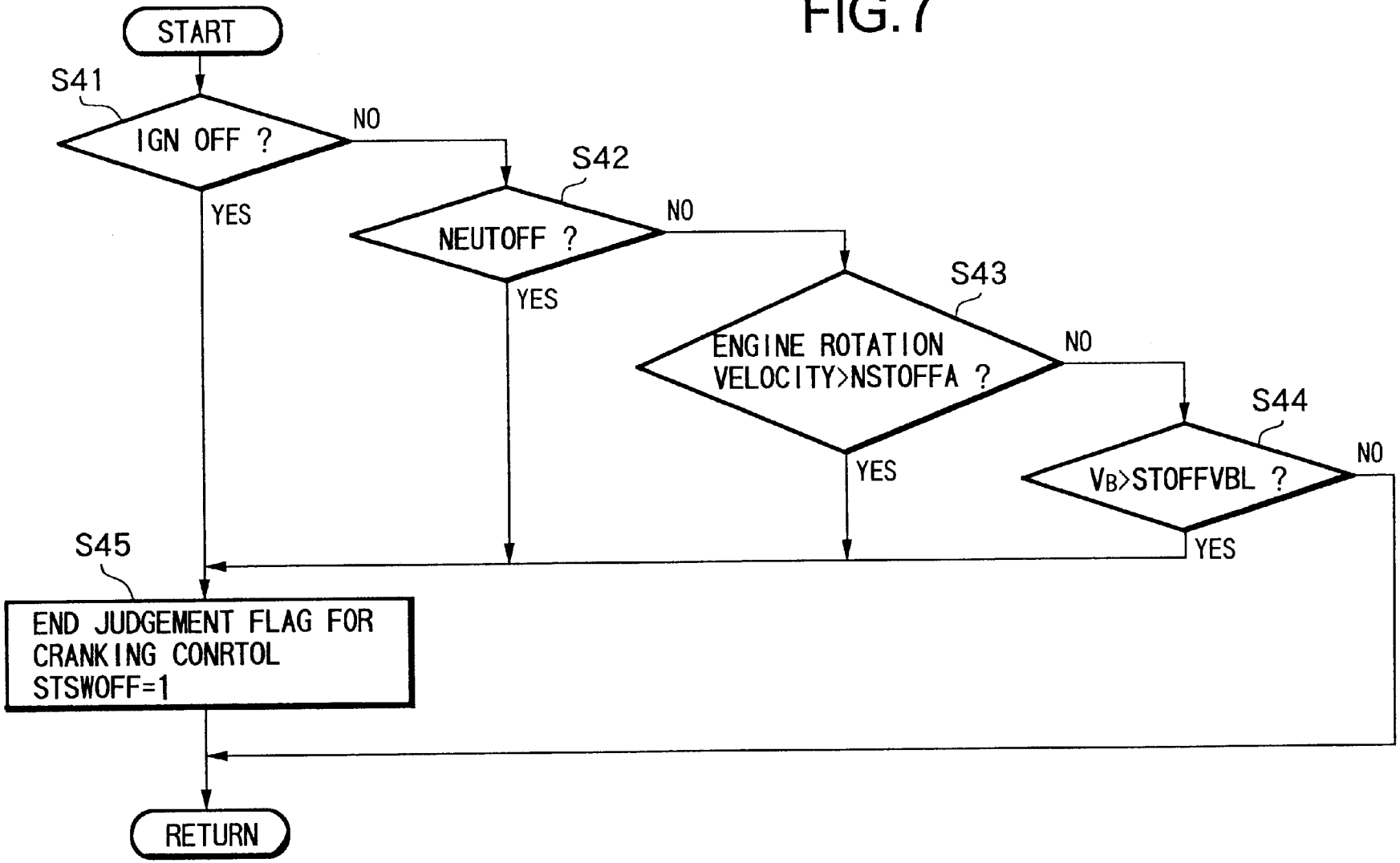
FIG. 7 is a flowchart showing a routine setting an end judgement flag for the cranking control.

FIG. 7 shows a routine for setting an end judgement to end cranking control after setting the judgement flag for the cranking control and cranking control has been started. Thus, when any of the following occurs: (a) the ignition switch switches off (step S 41), (b) the neutral switch switches off (step S 42), (c) the engine rotation velocity Ne exceeds a set rotation velocity NSTOFFA stable after the engine combustion completion (step S 43), or (d) the battery voltage returns to greater than a reference voltage STOFFVBL when the starter stops (step S 44), the end judgement flag STSWOFF for the cranking control is set as 1 at step S 45.

Thereby, the cranking control ends and at step S 7 in FIG. 2, the flag STSW is reset as 0 and the end of the cranking control is stored.

This application claims priority to Japanese Patent Application No. 2001-394570 filed Dec. 26, 2001. The entire disclosure of Japanese Patent Application No. 2001-394570 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined by the appended claims and their equivalents. Moreover, features of the different embodiments may be combined.

What is claimed:

1. An engine control apparatus, comprising:

a starter that cranks the engine;

a rotation velocity detector that detects engine rotation velocity;

a battery voltage detector that detects a battery voltage;

a controller that starts engine cranking control when the controller determines that the engine is being cranked by the starter, wherein the controller determines that the engine is being cranked by the starter based on when a prior cranking control ends, the engine rotation velocity is equal to or less than a first predetermined limit velocity that leads to an engine stall, and the battery voltage for driving the starter falls to or below a predetermined low voltage value.

2. An apparatus according to claim 1, wherein the controller determines that the engine is being cranked by the starter when the controller judges an engine rotation velocity increase after the prior cranking control ends, the engine rotation velocity is equal to or less than the first predetermined limit velocity that leads to the engine stall, and the battery voltage for driving the starter falls to or below the predetermined low voltage value.

3. An apparatus according to claim 2, wherein the controller judges the engine rotation velocity increase by using a second engine rotation velocity detection signal having a cycle longer than a cycle of the engine rotation velocity detection signal used at the time the engine rotation velocity is judged to be equal to or less than the first predetermined limit velocity.

4. An apparatus according to claim 2, wherein the controller judges the engine rotation velocity increase when the engine rotation velocity continuously increases over a predetermined period of time.

5. An apparatus according to claim 4, wherein the rotation velocity detector measures engine rotation velocity is measured at predetermined time intervals, and the controller judges the engine rotation velocity increase when the engine rotation velocity increases at least at two successive time intervals.

6. An apparatus according to claim 2, wherein the controller determines that the engine is being cranked by the starter when the engine rotation velocity increased is equal to or less than a rotation velocity at an engine combustion completion.

7. An apparatus according to claim 1, wherein the controller determines that the engine is being cranked by the starter when, after the prior cranking control ends, the engine rotation velocity is equal to or less than the first predetermined limit velocity that leads to the engine stall, and the battery voltage for driving the starter falls to or below the predetermined low voltage value, the engine rotation velocity remains at or less than a predetermined engine rotation velocity at an engine combustion completion after a predetermined time elapse.

8. An engine control apparatus, comprising:

starter means for cranking the engine;

rotation velocity detection means for detecting an engine rotation velocity;

battery voltage detection means for detecting a battery voltage of a battery that drives the starter;

cranking judgement means for judging that the engine is being cranked by the starter based on when a prior cranking control ends, the engine rotation velocity is equal to or less than a limit rotation velocity leading to an engine stall, and the battery voltage falls to or below a predetermined value; and cranking control means for starting the cranking control when the cranking judgement means judges that the engine is being cranked by the starter.

9. A method for controlling an engine, comprising:

providing a starter that cranks an engine;

detecting an engine rotation velocity;

detecting a battery voltage for a battery that serves the starter;

judging that the engine is being cranked by the starter based on when a prior cranking control ends, the engine rotation velocity is equal to or less than a limit rotation velocity that leads to an engine stall, and the battery voltage falls to or below a predetermined value; and starting a cranking control after judging that the engine is being cranked by the starter.

10. An engine control apparatus, comprising:

a starter that cranks the engine;

a rotation velocity detector that detects engine rotation velocity;

a battery voltage detector that detects a battery voltage of a battery that serves the starter;

a controller that starts engine cranking control when the controller determines that the engine is being cranked by the starter, wherein the controller determines that the engine is being cranked by the starter based on when, during engine rotation, the battery voltage falls to or below a predetermined low voltage value, and the engine rotation velocity remains at or below a predetermined engine rotation velocity at an engine combustion completion for a predetermined period of time.

11. An apparatus according to claim 10, wherein the controller determines that the engine is being cranked by the starter when the controller judges an engine rotation velocity increase after the prior cranking control ends, the engine rotation velocity is equal to or less than the first predetermined limit velocity that leads to the engine stall, and the battery voltage for driving the starter falls to or below the predetermined low voltage value.

12. An apparatus according to claim 11, wherein the controller judges the engine rotation velocity increase by using a second engine rotation velocity detection signal having a cycle longer than a cycle of the engine rotation velocity detection signal used at the time the engine rotation velocity is judged to be equal to or less than the first predetermined limit velocity.

13. An apparatus according to claim 11, wherein the controller judges the engine rotation velocity increase when the engine rotation velocity continuously increases over a predetermined period of time.

14. An apparatus according to claim 13, wherein the rotation velocity detector measures engine rotation velocity is measured at predetermined time intervals, and the controller judges the engine rotation velocity increase when the engine rotation velocity increases at least at two successive time intervals.

15. An apparatus according to claim 11, wherein the controller determines that the engine is being cranked by the starter when the engine rotation velocity increased is equal to or less than a rotation velocity at an engine combustion completion.

16. An apparatus according to claim 10, wherein the controller determines that the engine is being cranked by the starter when, after the prior cranking control ends, the engine rotation velocity is equal to or less than the first predetermined limit velocity that leads to the engine stall, and the battery voltage for driving the starter falls to or below the predetermined low voltage value, the engine rotation velocity remains at or less than a predetermined engine rotation velocity at an engine combustion completion after a predetermined time elapse.

* * * * *